US006247779B1

(12) United States Patent
Nowell, Jr. et al.

(10) Patent No.: US 6,247,779 B1
(45) Date of Patent: Jun. 19, 2001

(54) PRINTHEAD CONFIGURATION

(75) Inventors: Ronald Monroe Nowell, Jr., Lexington; David Amos Ward, Cynthiana; Michael David Lattuca, Lexington; Michael Raulinaitis, Lexington; Shirish Padmakar Mulay, Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/365,267

(22) Filed: Jul. 30, 1999

(51) Int. Cl.[7] ..... B41J 29/377; B41J 2/05
(52) U.S. Cl. ..... 347/18; 347/65
(58) Field of Search ..... 347/18, 63, 65, 347/50

(56) References Cited

U.S. PATENT DOCUMENTS

| | | | | |
|---|---|---|---|---|
| 4,894,664 | * | 1/1990 | Tsung Pan | 347/18 |
| 4,929,969 | | 5/1990 | Morris | 347/65 |
| 4,942,408 | | 7/1990 | Braun | 347/65 |
| 5,459,989 | | 10/1995 | Genevray | 57/117 |
| 5,512,924 | | 4/1996 | Takada et al. | 347/18 |
| 5,563,642 | | 10/1996 | Keefe et al. | 347/65 |
| 5,712,669 | | 1/1998 | Swanson et al. | 347/49 |
| 5,751,324 | | 5/1998 | Brandon et al. | 347/87 |
| 5,818,478 | | 10/1998 | Gibson | 347/45 |
| 6,076,912 | * | 6/2000 | Murthy | 347/18 |

* cited by examiner

*Primary Examiner*—John E. Barlow, Jr.
*Assistant Examiner*—Juanita Stephens
(74) *Attorney, Agent, or Firm*—Dinsmore & Shohl

(57) ABSTRACT

A printhead comprises a source of ink, a body, a mounting base, and an ink heater thermally coupled to the mounting base. A flowpath delivers ink from the ink source to the heater and is defined at least in part by the mounting base on the body. Three or more thermally conductive paths extend from the mounting base to the body. Preferably, one or more of the thermally conductive paths are heat conductive bridges extending from the mounting base to the body through an edge feed via.

20 Claims, 6 Drawing Sheets

PRINTHEAD CONFIGURATION

TECHNICAL FIELD

The present invention relates generally printers, and will be specifically disclosed as an improved printhead arrangement for ink jet printers.

BACKGROUND OF THE INVENTION

Thermal inkjet print cartridges operate by rapidly heating a small volume of ink to cause the ink to vaporize and be ejected through one of a plurality of orifices so as to print a dot of ink on a recording medium, such as a sheet of paper. Typically, the orifices are arranged in one or more linear arrays in a nozzle member. The properly sequenced ejection of ink from each orifice causes characters or other images to be printed upon the paper as the printhead is moved relative to the paper. The paper is typically shifted each time the printhead has moved across the paper. The thermal inkjet printer is fast and quiet, as only the ink strikes the paper. These printers produce high quality printing and can be made both compact and affordable.

An inkjet printhead generally includes: (1) ink channels to supply ink from an ink reservoir to each vaporization chamber proximate to an orifice; (2) a metal orifice plate or nozzle member in which the orifices are formed in the required pattern; and (3) a silicon substrate containing a series of thin film resistors, one resistor per vaporization chamber.

To print a single dot of ink, an electrical current from an external power supply is passed through a selected thin film resistor. The resistor is then heated, in turn superheating a thin layer of the adjacent ink within a vaporization chamber, causing explosive vaporization, and, consequently, causing a droplet of ink to be ejected through an associated orifice onto the paper.

A series of film resistors are generally grouped together into a single microcircuit or heater chip. Typically, the heater chip is mounted on a base or substrate. The ink reservoir is generally, but not necessarily always, located below the base and the heater chip is mounted on the top of the base. Ink channel configurations can vary widely, however, one desirable configuration uses an edge feed via. In an edge feed via configuration, the ink channels extend on one or more of the edges of the heater chip. For instance, one common edge feed via configuration has two ink channels, each one delivering ink to the length-wise edges of the heater chip. The heater chips are designed to operate at a particular range of temperatures. If a heater chip overheats, a variety of problems can result, such as nozzle failure, droplet misdirection, excessive droplet splatter, etc. Typically, as the print speeds increase, more heat is generated by the heater chips. To avoid overheating, it is desirable to transfer heat away from the heater chips. Generally, the outside of a printhead include a series of cooling fins to transfer heat from the printhead to the ambient air. However, in an edge feed via configuration, the ink channels act as insulators (due in part to the relatively low thermal conductivity of ink) preventing the heat transfer from the heater chip to the cooling fins. As such, it is desirable to improve the heat transfer characteristics in a printhead.

SUMMARY OF THE INVENTION

Accordingly, one object of the invention is to provide a printhead with improved heat removal characteristics. Additional objectives, advantages and novel features of the invention will be set forth in the description that follows and, in part, will become apparent to those skilled in the art upon examining or practicing the invention. The objects and advantages of the invention may be realized and obtained by means of the instrumentalities and combinations particularly pointed out in the appended claims.

One aspect of the present invention is a printhead having an ink source, a body, and a mounting base. An ink heater is thermally coupled to the mounting base. A flowpath is defined at least in part by the mounting base and the body, and is used for delivering ink from the ink source to the ink heater. Three or more thermally conductive bridges extend from the mounting base to the body. Preferably, the printhead uses an edge feed via configuration, and one or more of the thermally conductive bridges spans the edge feed via.

Another aspect of the present invention is a printhead having an ink reservoir, a body, and a vaporization chamber including an orifice. An ink heater is provided for heating ink in the vaporization chamber to facilitate the ejection of the ink therein out through the orifice. An edge feed via is used for delivering ink from the ink reservoir to the vaporization chamber. One or more thermal bridges are positioned in the edge feed via and provide a conductive heat transfer path from the heater chip to the body. The thermal bridges have a thermal conductivity greater than thermal conductivity of the ink. Preferably, the body and thermal bridges are formed from a homogenous material such as aluminum.

Still other aspects of the present invention will become apparent to those skilled in the art from the following description of a preferred embodiment, which is by way of illustration, one of the best modes contemplated for carrying out the invention. As will be realized, the invention is capable of other different and obvious aspects, all without departing from the invention. Accordingly, the drawings and descriptions are illustrative in nature and not restrictive.

BRIEF DESCRIPTION OF THE DRAWINGS

The accompanying drawings, incorporated in and forming part of the specification, illustrate several aspects of the present invention and, together with their descriptions, serve to explain the principles of the invention. In the drawings.

Reference will now be made to the present preferred embodiment of the invention, an example of which is illustrated in the accompanying drawings, wherein like numerals indicate the same element throughout the views.

DETAILED DESCRIPTION

Figure 1:
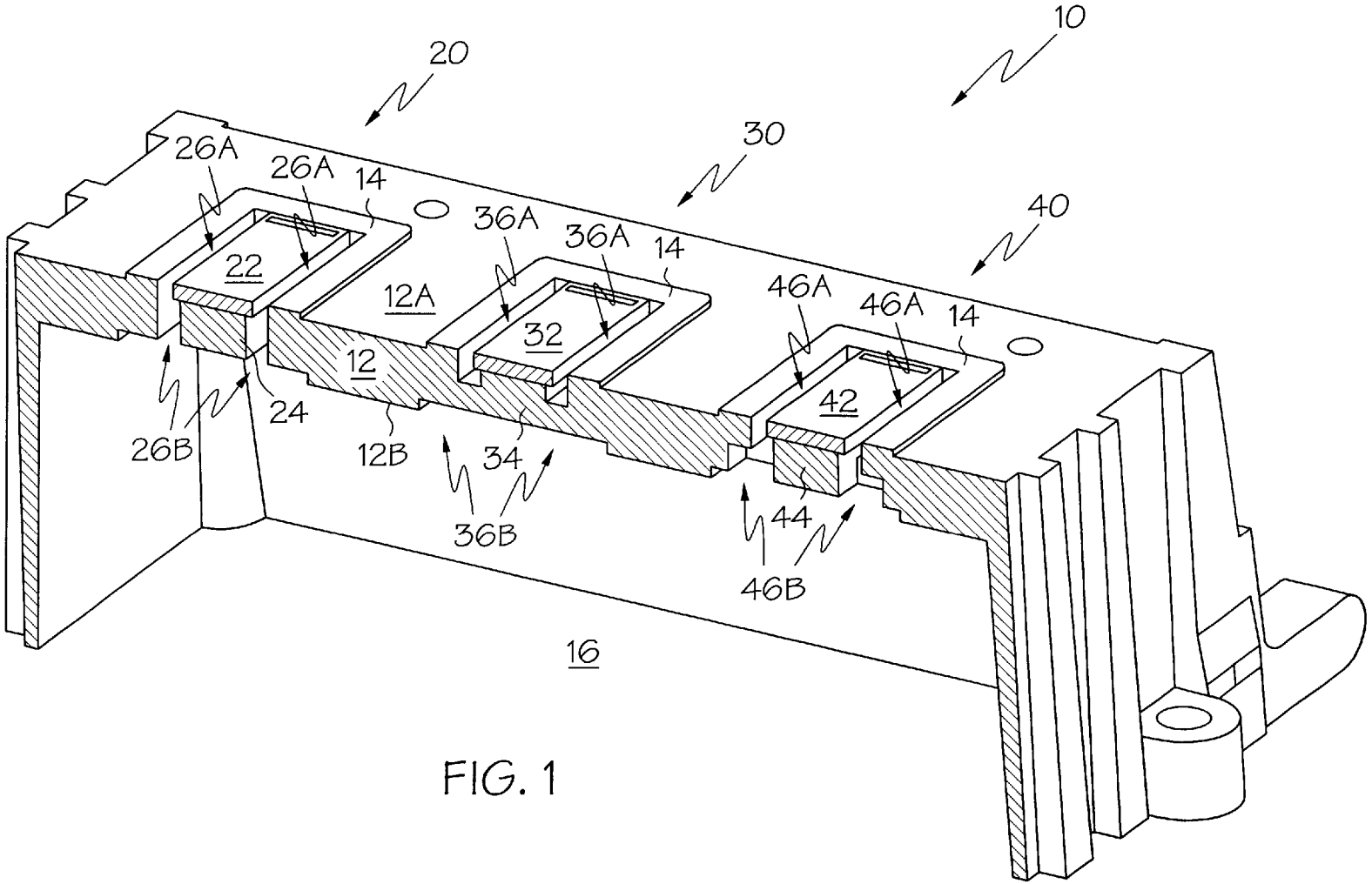
FIG. 1 depicts a top oblique view of a printhead, partially in cross-section.

FIG. 1 depicts a cross-sectional view of a printhead 10 for an inkjet printer. The printhead 10 is a component of a printer cartridge. The printhead 10 comprises a body 12 having a top 12A and a bottom 12B. The body 12 defines a cavity which acts as an ink source, shown here as a reservoir 16 to store ink. The body 12 can be formed from a variety of materials and is preferably made from plastic or metal.

A printhead typically includes one or more heater chips. If multiple heater chips were employed, it is preferred that each heater chip would embody similar geometry. For the purposes of illustration, printhead 10 is depicted with three heater chip configurations 20, 30, 40. In configuration 20, the heater chip 22 is mounted on the base 24 (sometimes referred to as a substrate). The tab circuit (not shown) is mounted on the tab circuit pad 14 and defines a vaporization chamber located between the heater chip 22 and the tab circuit. The configuration 20 illustrates one example of an edge feed via, which is the ink channel extending from the inlet 26B to the outlet 26A. Ink in the reservoir 16 enters the ink channel inlet 26B, which is positioned on both sides of the base 24. The ink travels through ink channel and exists the ink channel outlet 26A, which is positioned on either side of the heater chip 22. Ink exiting the ink channel outlet 26A is delivered to the vaporization chamber. Controlled heating of the heater chip 22 vaporizes ink in the vaporization chamber causing it to eject through orifices in the tab circuit and onto a receiving surface such as paper.

Configurations 30,40 operate in much the same way as configuration 20. Heater chips 32, 42 are mounted on bases 34, 44, respectively. The configurations 30,40 are also examples of edge feed via. Ink from the reservoir 16 enters ink channel inlets 36B, 46B, travel up through and exit the ink channel outlets 36A, 46A, and are delivered to a vaporization chamber positioned above the heater chips 32, 42, respectively.

Figure 2:
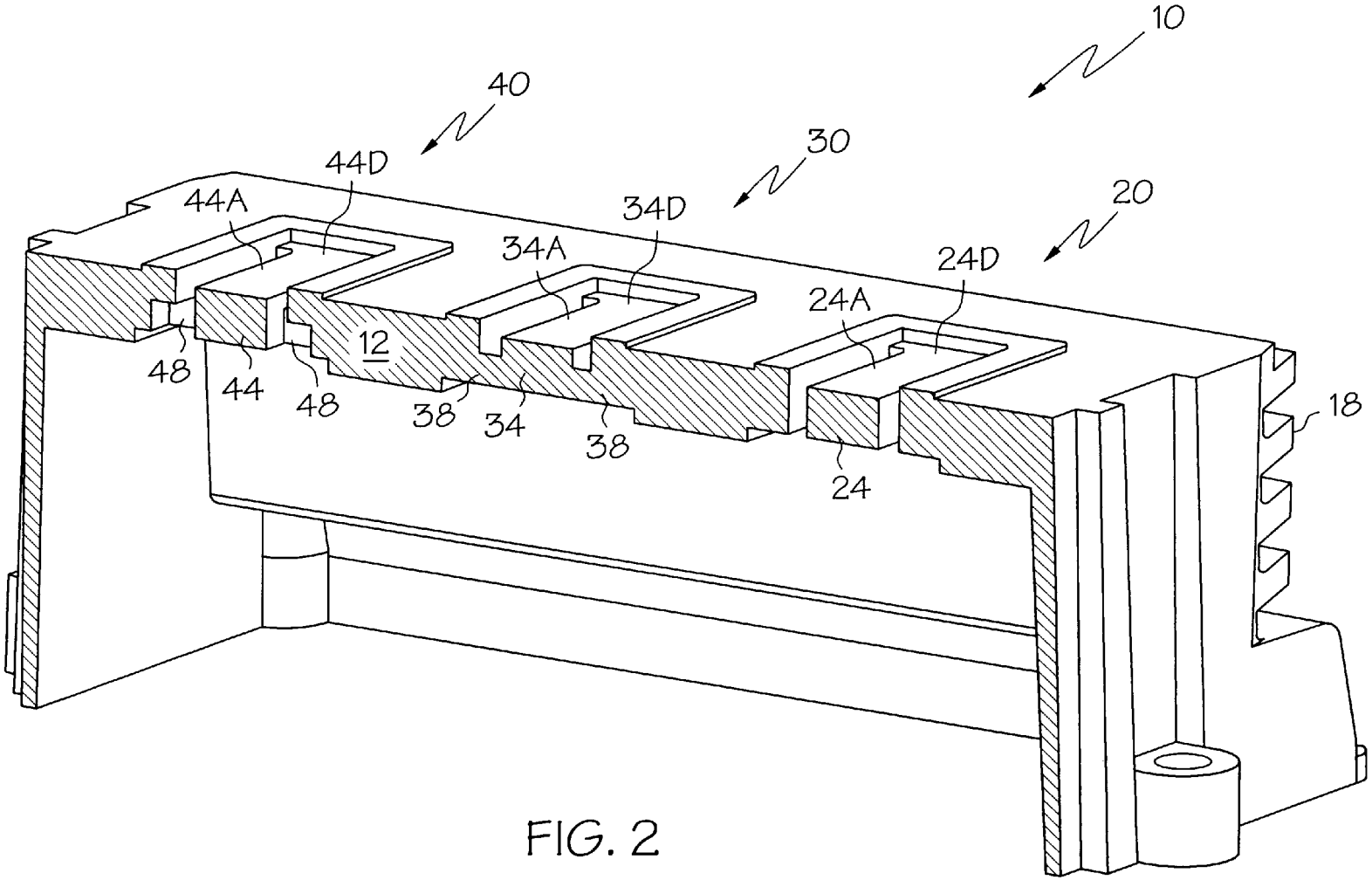
FIG. 2 depicts a top oblique view of a printhead without heater chips, partially in cross-section.

FIG. 2 depicts a cross-sectional view of the heater chip 10 viewed from the opposite side depicted in FIG. 1. The heater chips 22, 32, 42 are not depicted in FIG. 2. The configuration 20 includes a base 24 having two ends 24D connected to the printhead body 12. Because FIG. 2 is a cross-sectional view, only one end 24D is depicted. The heater chip is mounted to the top 24A of the base 24. In use, the heater chip generates heat which is thermally conducted to the base 24. Heat from the base 24 is conducted through the ends 24D to the printhead body 12, and eventually travels to the cooling fins 18. Heat is then dissipated to the ambient air through the cooling fins 18. As such, the configuration 20 includes two thermally conducted paths extending from the base 24 to the body 12 (i.e., the two ends 24D of the base 24).

The configuration 30 includes four thermally conductive paths for transferring heat from the base 34 to the body 12. The heater chip is mounted on the top surface 34A of the base 34. Heat generated from the heater chip is transferred to the base 34 and is conducted to the body 12 through the two ends 34D, thus providing two of the thermally conductive paths. The configuration 30 also includes two thermally conductive bridges 38 positioned in the edge feed via and extending from the base 34 to the body 12. As such, the thermal bridges 38 provide two thermally conductive paths for transferring heat from the base 34 to the body 12. Like the configuration 20, heat conducted from the base 34 to the body 12 is dissipated to the ambient air through the cooling fins 18.

The configuration 40 provides six thermally conductive paths for transferring heat from the base 44 to the body 12. The heater chip is mounted on the top 44A of the base 44. Heat generated by the heater chip is conducted from the base 44 to the body 12 through the two ends 44D, thus providing two thermally conductive paths. In addition, four thermally conductive bridges 48 extend from the base 44 to the body 12, two bridges 48 being positioned in each edge feed via. Like the other configurations 20, 30, heat conducted from the base 44 to the body 12 is dissipated to the ambient air through the cooling fins 18.

Preferably, the body 12, thermal bridges 38, 48, bases 24, 34, 44 and cooling fins 18 are all formed from a homogenous material. Ideally, the homogenous material has a thermal conductivity greater than that of the ink. Preferably, the homogenous material has a thermal conductivity greater than or equal to about 0.6 watts per meter degree Kelvin, more preferably greater than or equal to about 6 watts per meter degree Kelvin, and most preferably greater than or equal to about 10 watts per meter degree Kelvin. In one embodiment, the homogenous material is a cast aluminum which exhibits a thermal conductivity of about 96 watts per meter degree Kelvin.

Figure 3:
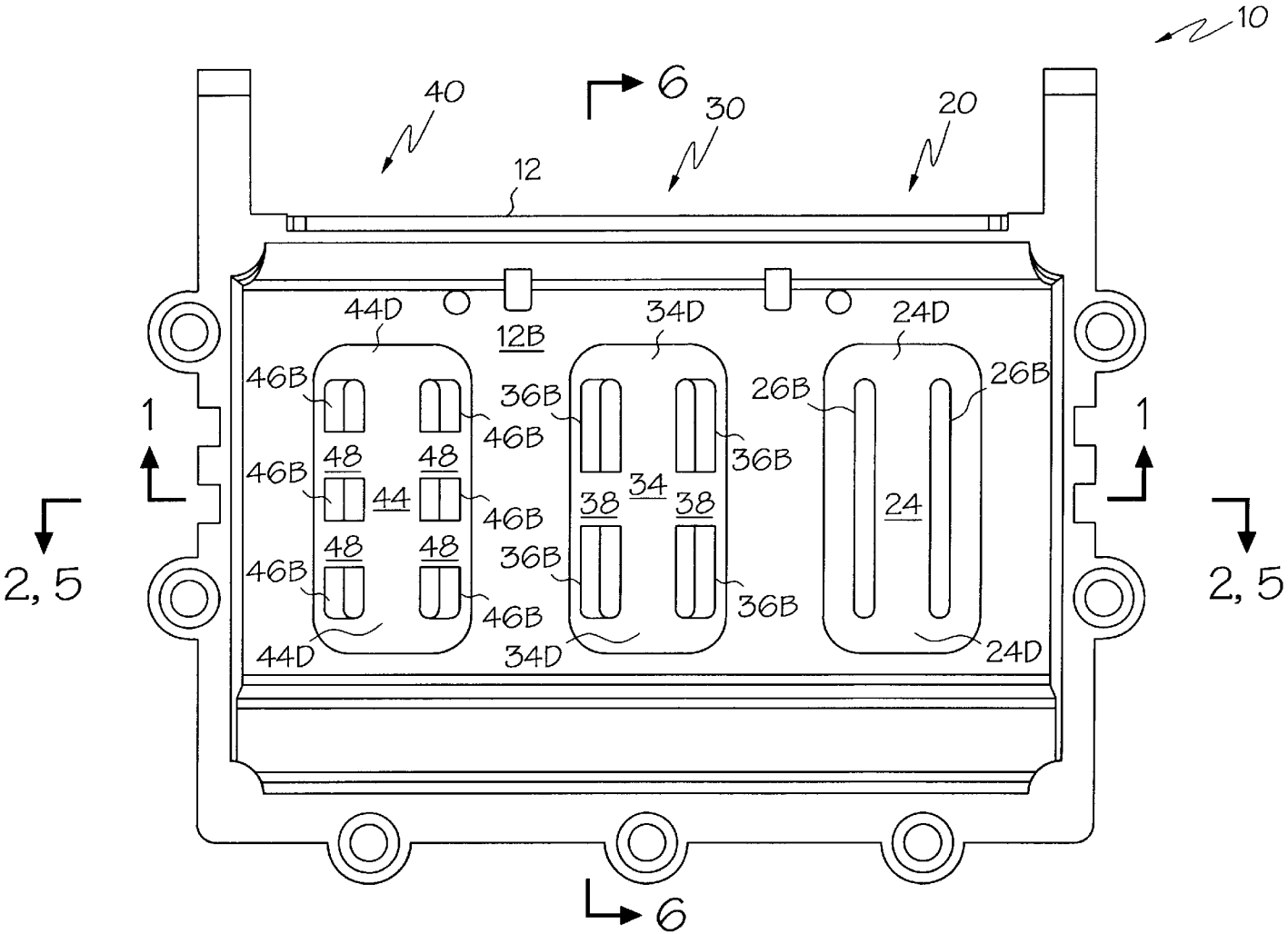
FIG. 3 depicts a bottom view of a printhead.

FIG. 3 depicts the bottom view of the printhead 10 looking up through the ink reservoir 16 to the bottom surface 12B of the printhead body 12. The various cross-sections for the figures are depicted around the periphery of the printhead 10. Configuration 20 includes two ink channel inlets 26B, each positioned on either side of the base 24. As shown here, both ends of the base 24D are depicted. In configuration 30, a total of four ink channel inlets 36B are provided. The inlets are defined by the spaces between the base 24, the body 12, and the thermal bridges 38. All four of the thermally conductive paths from the base 34 to the body 12 can be seen in this figure. Namely, the two base ends 34D provide two thermally conductive paths, and the thermal bridges 38 provide the other two thermally conductive paths. In configuration 40, a total of six ink channel inlets 46B are provided. The ink channel inlets 46B are defined by the spaces between the base 44, the body 12, and the thermal bridges 48. The sixth thermally conductive paths from the base 44 to the body 12 comprise the two base ends 44D and the four thermal bridges 48.

Figure 4:
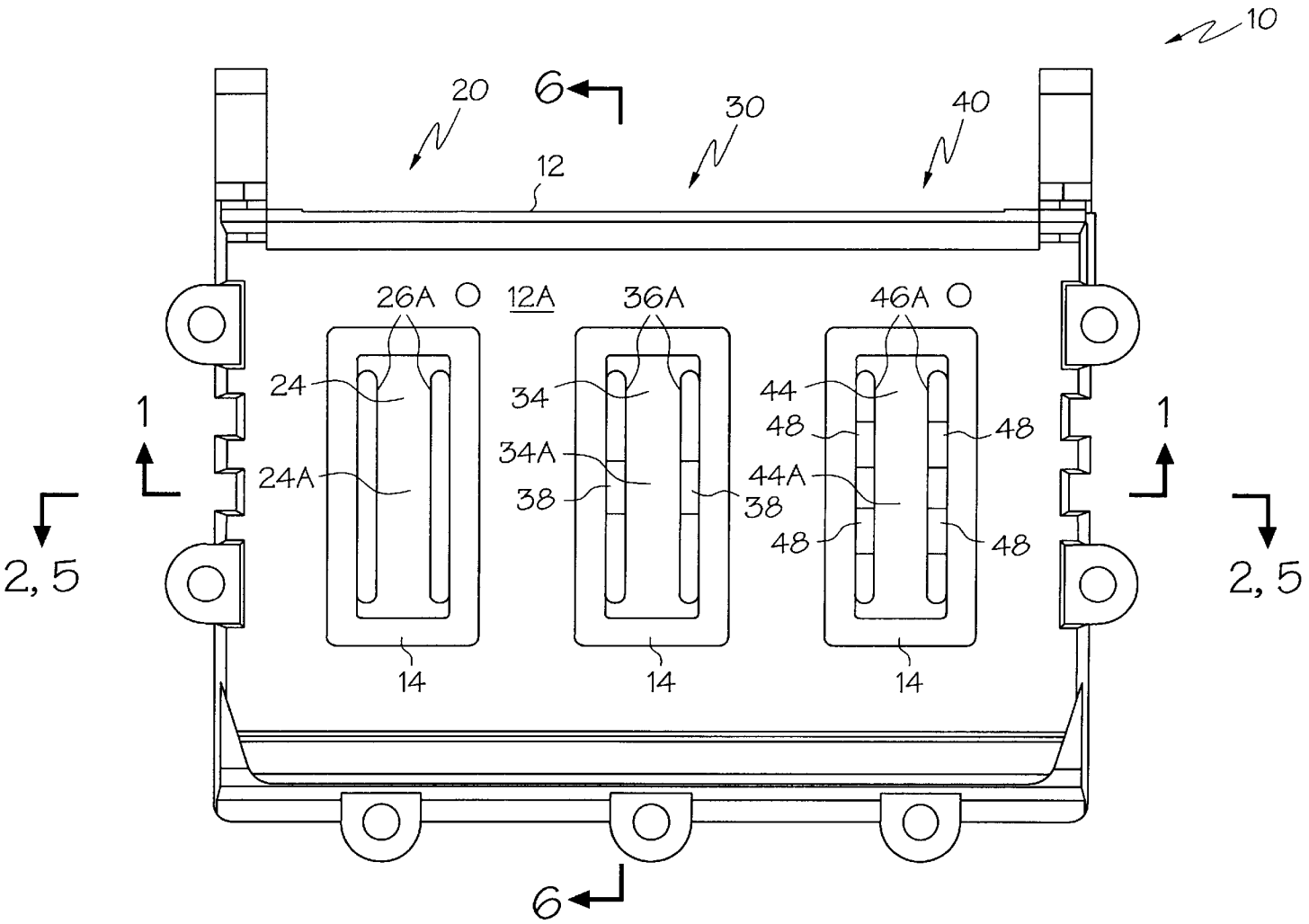
FIG. 4 depicts a top view of a printhead.

FIG. 4 depicts a top view of the printhead 10 looking at the top surface 12A of the base 12. In configuration 20, the ink channel outlets 26A are continuous and positioned on either side of the base 24. In configuration 30, the ink channel outlets 36A are also continuous on either side of the base 34. The continuous ink channel outlets 36A are possible because the bridges 38 are recessed below the top surface 34A of the base 34. Likewise, the configuration 40 includes two continuous ink channel outlets 46A. The thermal bridges 48 are similarly recessed below the top surface 44A of the base 44.

Figure 5:
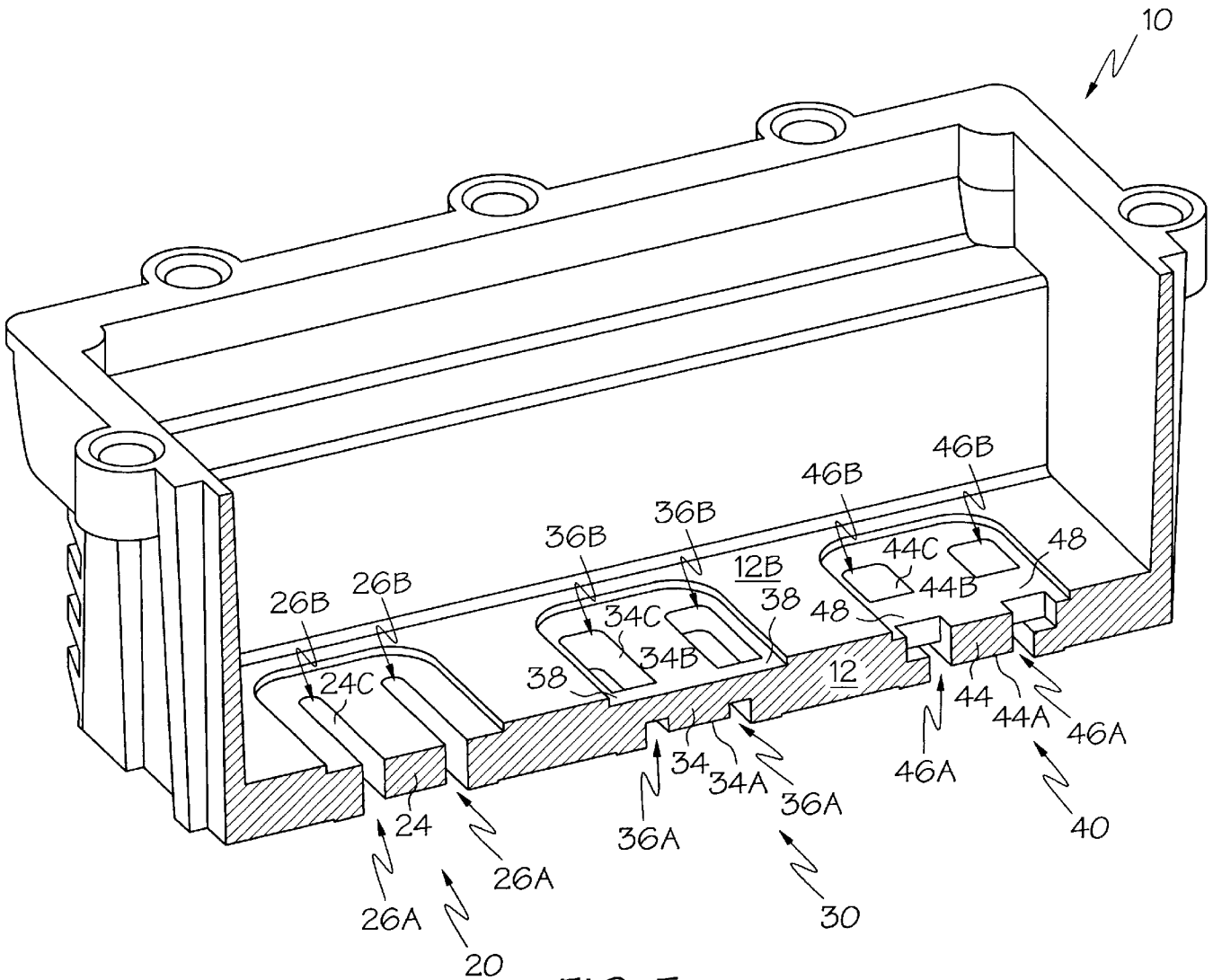
FIG. 5 depicts a bottom oblique view of a printhead, partially in crosses-section.

FIG. 5 shows a bottom oblique cross-sectional view of the printhead 10. In configuration 20, the ink channels extending from the inlets 26B to the outlets 26A are a constant cross-sectional area. In other words, the distance from the side 24C of the base 24 to the body 12 is constant dimension relative to the base 24. Configurations 30 and 40 depict an alternative geometry in which the cross-sectional dimension of the ink channels vary. As shown in configuration 30, the ink channel inlet 36B is wider than the outlet 36A. Preferably, the opening ratio from the inlet 36B to the outlet 36A (i.e., the distance from the side 34C to the body 12) has a ratio of 2 to 1. The present figure also illustrates on preferred geometry in which the thermal bridges 38 are even with the lower surface 34B of the base 34, but are recessed below the top surface 34A of the base 34. Likewise, in configuration 40, the opening ratio of the inlet 46A to the outlet 46B has a ratio of 2 to 1. The bridges 48 are also recessed below the top surface 44A of the base 44 and are even with the lower surface 44B.

Figure 6:
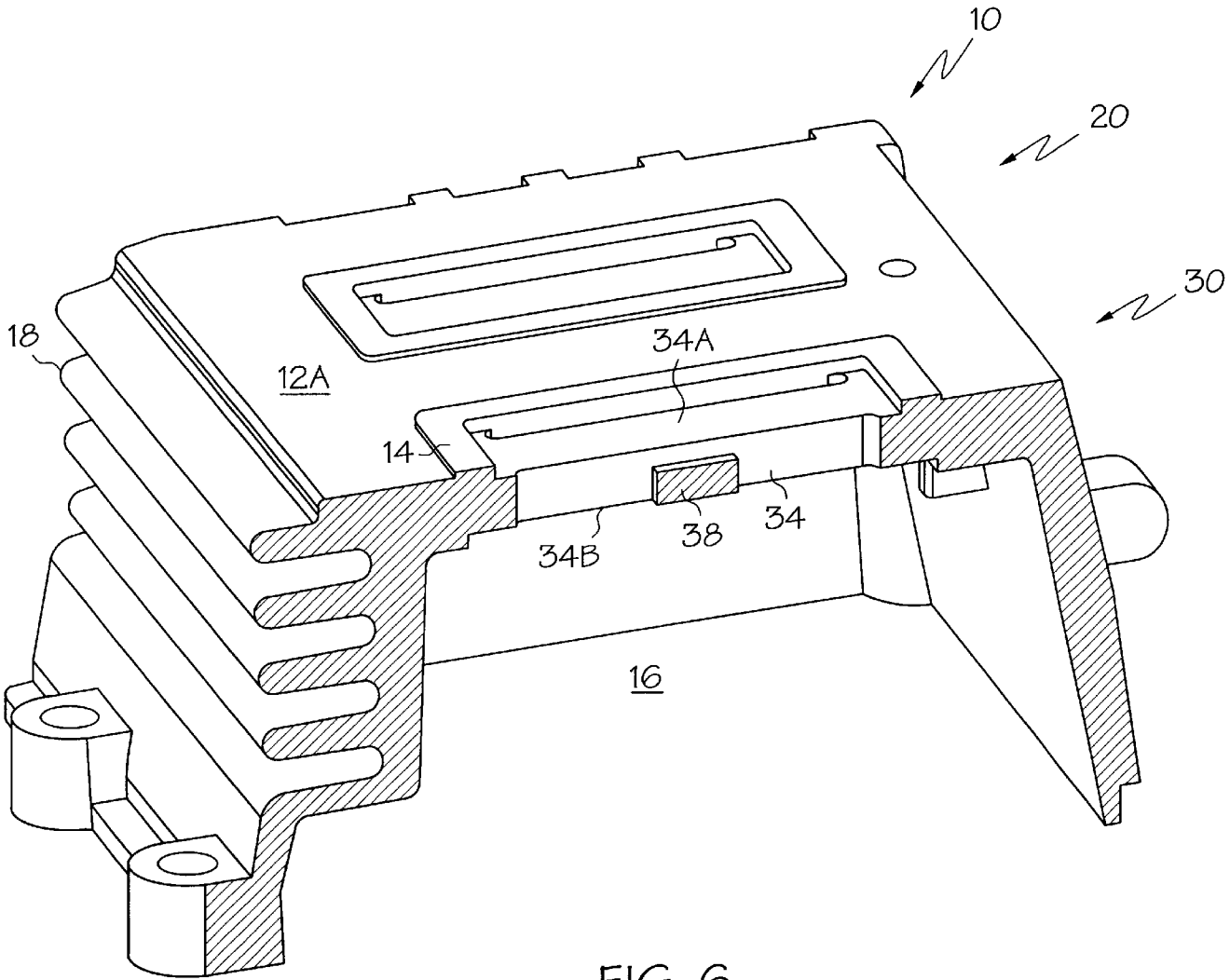
FIG. 6 depicts a top oblique view of a printhead, partially in cross-section.

FIG. 6 depicts a cross-sectional view of the printhead 10. The shape of the cooling fins 18 are shown in cross-section. The positioning of the thermal bridge 38 is also shown relative to the base 34. The thermal bridge 38 is recessed below the top surface 34A and is even with the lower surface 34B. As such, when a heater chip is mounted on the top surface 34A, the thermal bridge is recessed from the heater chip. One advantage of this preferred geometry is that ink flowing to the heater chips will be unobstructed around the edge of the heater chip, thus facilitating even ink flow into the vaporization chamber.

The foregoing description of the preferred embodiment of the invention has been presented for purposes of illustration and description. It is not intended to be exhaustive nor to limit the invention to the precise form disclosed. Many alternatives, modifications, and variations will be apparent to those skilled in the art in light of the above teaching. For instance, the present invention could be used in configurations other than edge feed via. Accordingly, this invention is intended to embrace all alternatives, modifications, and variations that fall within the spirit and broad scope of the amended claims.

We claim:

1. A printhead, comprising:

a) a source of ink;

b) a body;

c) a mounting base;

d) an inkheater thermally coupled to the mounting base;

e) a flowpath for delivering ink from the ink source to the ink heater, the flowpath being defined by at least in part the mounting base and the body; and f) one or more thermally conductive paths provided by thermal bridges spanning the flowpath and extending from the mounting base to the body for transferring heat from the base to the body.

2. The printhead of claim 1, wherein the body, mounting base, and thermally conductive paths are formed from a homogenous material.

3. The printhead of claim 2, wherein the homogenous material has a thermal conductivity greater than or equal to about 10 watts per meter degree Kelvin.

4. The printhead of claim 2, wherein the homogenous material is aluminum.

5. The printhead of claim 1, wherein the flowpath is an edge feed via.

6. The printhead of claim 5, wherein one or more of the thermally conductive paths is recessed from the ink heater.

7. The print head of claim 5, wherein one or more of the thermally conductive paths spans the edge feed via.

8. The printhead of claim 1, wherein the ink heater comprises a plurality of thin film resistors contained in a heater chip.

9. An ink jet printer cartridge, comprising the printhead of claim 1.

10. An ink jet printer, comprising the printhead of claim 1.

11. A printhead, comprising:

a) an ink reservoir;

b) a body;

c) a vaporization chamber including an orifice;

d) a heater chip for heating ink in the vaporization chamber to facilitate the ejection of ink therein out through the orifice;

e) an edge feed via for delivering ink from the ink reservoir to the vaporization chamber; and f) one or more thermal bridges positioned in the edge feed via and providing a conductive heat transfer path from the heater chip to the body, said thermal bridges having a thermal conductivity greater than the thermal conductivity of the ink.

12. The printhead of claim 11, wherein the body and thermal bridges are formed from a homogenous material.

13. The printhead of claim 12, wherein the homogenous material has a thermal conductivity greater than or equal to about 10 watts per meter degree Kelvin.

14. The printhead of claim 12, wherein the thermal bridges are recessed from the ink heater.

15. The printhead of claim 11, further comprising a substrate upon which the heater chip is coupled.

16. An ink jet printer cartridge, comprising the printhead of claim 11.

17. An ink jet printer, comprising the printhead of claim 11.

18. A printhead, comprising:

a) a source of ink;

b) a body;

c) a mounting base;

d) an ink heater thermally coupled to the mounting base;

e) an edge feed via for delivering ink from the ink source to the ink heater; and f) a thermal bridge for conductively transferring heat from the mounting base to the body through the edge feed via.

19. An ink jet printer cartridge, comprising the printhead of claim 18.

20. An ink jet printer, comprising the printhead of claim 18.

* * * * *